United States Patent [19]

Spurgeon

[11] Patent Number: 4,836,815

[45] Date of Patent: Jun. 6, 1989

[54] EMERGENCY ILLUMINATED LIFELINE

[76] Inventor: Robert L. Spurgeon, 112 W. Douglas St., Fairfield, Ill. 62837

[21] Appl. No.: 176,315

[22] Filed: Mar. 31, 1988

[51] Int. Cl.[4] ..... B63C 9/26

[52] U.S. Cl. ..... 441/84; 441/13; 441/80; 362/202

[58] Field of Search ..... 441/6, 11, 13, 15, 80, 441/84, 85, 89; 43/16, 17, 17.1, 17.5; 174/101.5; 362/202–205; 16/209, 210

[56] References Cited

U.S. PATENT DOCUMENTS 1,372,591 3/1921 Bichek ..... 441/16
1,414,273 4/1922 Gwynn ..... 441/16
2,470,783 5/1949 Mead ..... 441/16
3,618,150 11/1971 Anselmi ..... 441/16

*Primary Examiner*—Joseph F. Peters, Jr.
*Assistant Examiner*—Edwin L. Swinehart
*Attorney, Agent, or Firm*—H. Jay Spiegel

[57] ABSTRACT

Disclosed herein is an improved emergency illuminated lifeline including a buoyant housing in which may be stored a length of line which may be payed out during an emergency. In the preferred embodiment, the housing also includes a battery powered light which may be activated by pulling on the end of the lifeline affixed in the housing. Two embodiments of actuation of the light through pulling of the line are disclosed.

7 Claims, 2 Drawing Sheets

FIG. 1
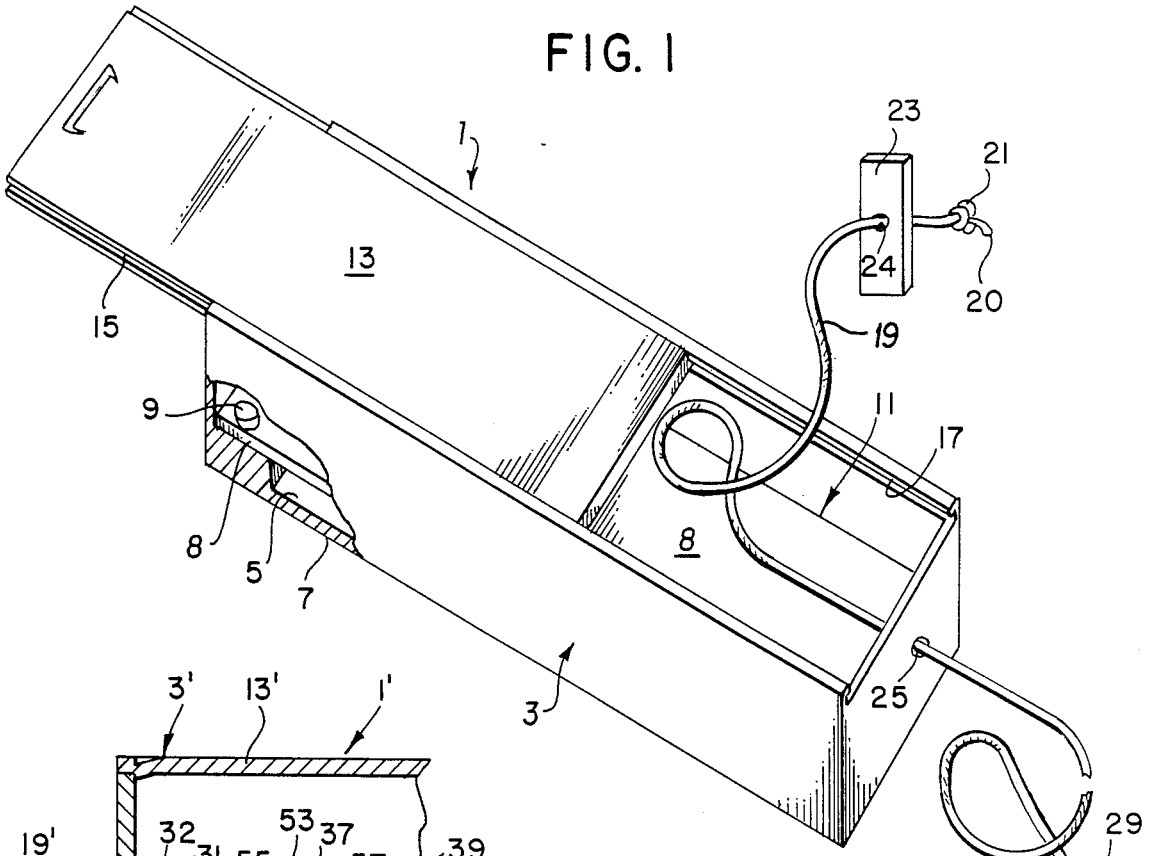
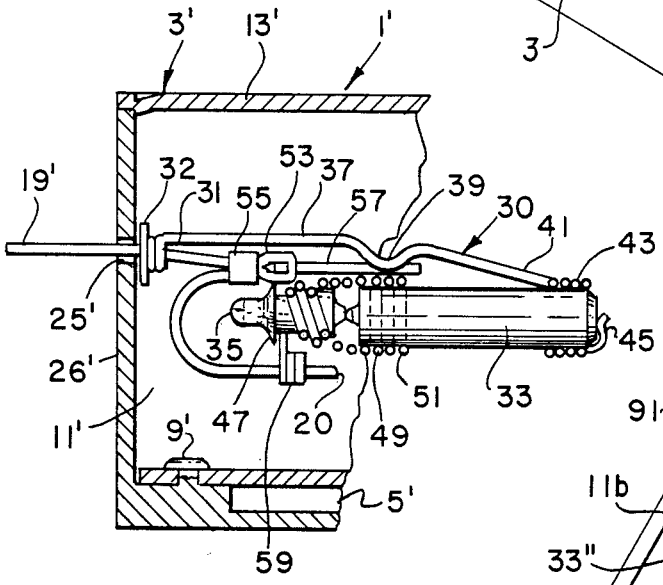
FIG. 2
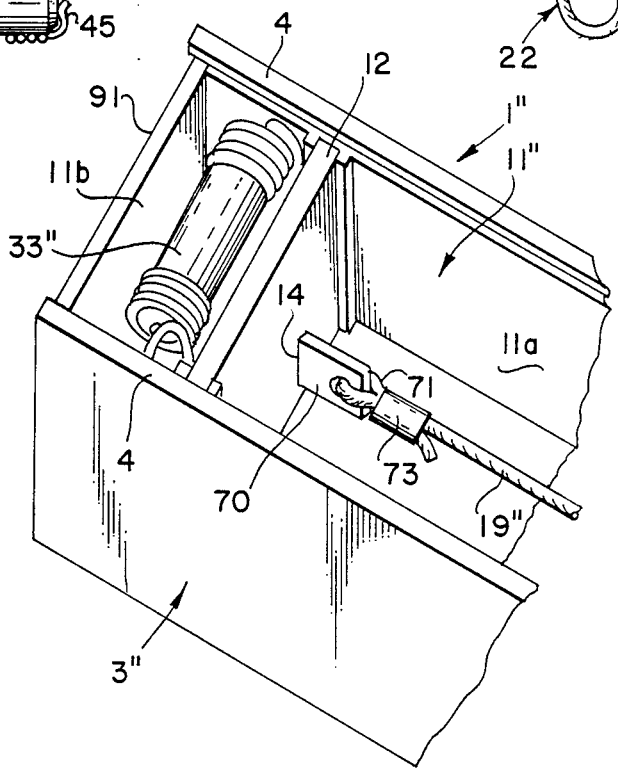
FIG. 3

EMERGENCY ILLUMINATED LIFELINE

BACKGROUND OF THE INVENTION

The present invention relates to an emergency illuminated lifeline. In the prior art, lifeline devices are known, however, up until this time, no such device has been invented which includes all of the details and structures included in the present invention.

The following prior art is known to applicant:

U.S. Pat. No. 2,192,203 to Purdy discloses a life saving apparatus including a housing having a float therein attached to a length of line on a reel. The line may be thrown by grasping the float. The present invention is different from the teachings of this patent since in the present invention, the housing is thrown and comprises a buoyant member and, further, since the present invention includes illumination means nowhere taught or suggested by Purdy.

U.S. Pat. No. 2,722,696 to Johnson discloses a lighted rescue lifeline including an elongated line having housings at spaced locations thereon which include bulbs illuminated froma remote power source. The present invention differs from the teachings of this patent as including a self contained power source which is thrown along with the buoyant housing to the point of rescue.

U.S. Pat. No. 3,016,549 to Finn discloses life saving equipment comprising an elongated stick which may be separated and a portion of which may be thrown to a point of rescue and having a line attached thereto. The present invention differs from the teachings of this patent as including a light actuator incorporated into the line.

U.S. Pat. No. 3,317,937 to Johnson, et al. discloses a safety device for boats including a float device having two reels of line which may be unreeled when the line is extended in a rescue. The present invention, of course, differs from the teachings of this patent as including illumination means activated by pulling of the line, among other reasons.

U.S. Pat. No. 3,911,515 to Rinfret, et al. discloses a line projection apparatus which includes no illumination means.

U.S. Pat. No. 4,160,298 to DeShano discloses a capsule for a life saving line and float wherein the capsule may float and the line is payed out therefrom. Of course, the present invention differs from the teachings of this patent as including illumination means and a means of actuation of the illumination means including the line.

SUMMARY OF THE INVENTION

The present invention overcomes the deficiencies of the prior art as discussed above by providing in a single integrated housing, buoyancy means as well as structure for storing a line to be payed out and illumination means which may be activated by jerking of the line. The present invention includes the following interrelated aspects and features:

(a) In a first aspect, the inventive device is embodied in an elongated rectangular cubic housing having a sealed chamber therein providing flotation. The housing includes a separate chamber in which are contained a length of line and battery powered illumination means.

(b) In one embodiment of the present invention, the second chamber is undivided and includes the length of line having the illumination means attached thereto in a manner allowing activation of the illumination means upon pulling of the length of line to its greatest extend from the housing. In a second embodiment, the illumination means is housed in a separate subchamber within the second chamber and is activated by tugging of the length of line.

(c) The second chamber is closed by a slidable lid which may be selectively slid to reveal the second chamber when it is desired to repack the line and reset the actuation device for the illumination means.

(d) In the preferred embodiment, the length of line will be extended through an opening formed in the housing and that end of the line will have a loop enabling attachment to some fixed object on land. With the line so affixed, the line is withdrawn from the housing, the line is then pulled further to turn on the illumination means, and the housing may then be tossed in the direction where a rescue is to be undertaken.

Accordingly, it is a first object of the present invention to provide an improved emergency illuminated lifeline.

It is a further object of the present invention to provide such an emergency illuminated lifeline including a buoyant housing designed to releasably house a length of line.

It is a still further object of the present invention to provide such a housing with illumination means which may be activated when the line is extended therefrom.

These and other ojbects, aspects and features of the present invention will be better understood from the following detailed description of the preferred embodiments when read in conjunction with the appended drawing figures.

BRIEF DESCRIPTION OF THE DRAWINGS

FIG. 1 shows a perspective view of the present invention with parts broken away to show detail.

FIG. 2 shows a portion of the device shown in FIG. 1 with further details shown.

FIG. 3 shows a perspective view of a second embodiment of the present invention.

SPECIFIC DESCRIPTION OF THE PREFERRED EMBODIMENTS

Figure 4:
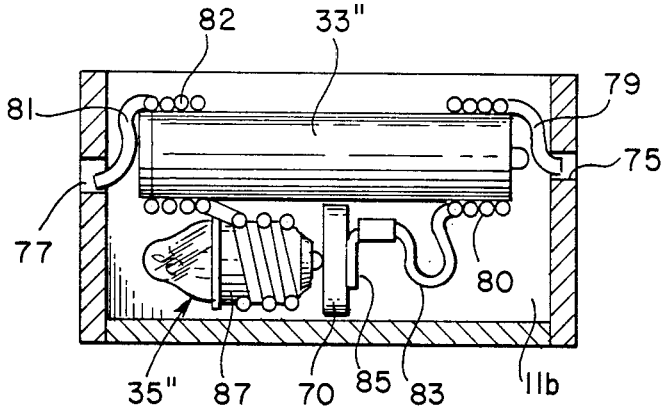
FIG. 4 shows a cross-sectional view along the line 4—4 of FIG. 3.

With reference first to FIG. 1, it is seen that the inventive device 1 includes a housing 3 of substantially rectangular cubic shape having a first chamber 5 defined by a bottom surface 7 of the housing 3 and a plate 8 spaced therefrom and mounted in overlying relation to the chamber 5 by appropriate fasteners 9.

Above the plate 7, a second chamber 11 is defined in the housing 3 and is closed by a removable sliding plate 13 seen in FIG. 1 in a partially open position and including elongated protrusions 15 designed to slide in grooves 17 at the top of the housing 3.

In the embodiment shown in FIGS. 1 and 2, the chamber 11 is undivided and comprises a chamber designed to receive an elongated length of line 19 which is knotted at 21 so as to retain a stop member 23 from falling off the end 20 of the line. As seen in FIG. 1, the housing 3 includes an opening 25 in one wall thereof designed to slidably receive the line 19 therethrough. At the other end 22 of the line 19, a loop 27 is formed by a retainer device 29. In assembling the line 19 to the housing 3, with the knot 21 non-existent, the end 20 thereof is inserted through the opening 25 of the housing 3 and then is inserted through an opening 24 in the stop 23 whereupon the knot 21 may be formed.

In the embodiment specifically shown in FIG. 1, when it is desired to utilize the device 1 for a rescue, the end 22 of the line 19 is secured to some land based object such as a pier, a tree or other rigid object. The line 19 is then withdrawn from the housing 3 and the housing 3 is thrown, allowing the loose line to be tossed out behind in the direction where a rescue is to be undertaken, with the housing 3 floating due to the presence of the flotation chamber 5.

FIG. 2 shows a second embodiment of the present invention wherein the housing 3 also has contained therein illumination means. With particular reference to FIG. 2, wherein like elements are designated by like primed reference numerals, it is seen that the end 20' of the line 19' does not have a knot formed thereon. Instead, the end 20' is extended through an opening 31 formed on a metallic member 30 comprising a casing designed to contain a battery 33 and illumination means such as a light bulb 35.

Figure 6:
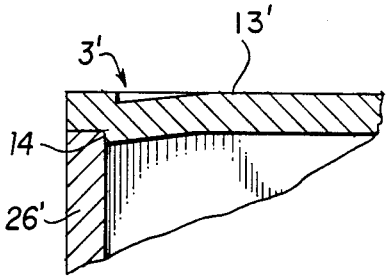
FIG. 6 shows a portion of FIG. 2 enlarged for better understanding.

With reference to FIGS. 2 and 6, it is seen that the plate 13' has a downwardly depending shoulder 14 designed to interact with the wall 26' to limit the extent to which the plate 13' may be slid on the housing 3'.

As seen in FIG. 2, the casing 30 includes an elongated portion 37 having a depressed contact portion 39 thereon and having an end 41 connected to a coiled portion 43 terminating at an abutment 45. As seen in FIG. 2, the abutment 45 is designed to limit the movement of the battery 33 in the right-hand direction of the figure.

As seen in FIG. 2, the light bulb 35 includes a threaded portion 47 about which is mounted a spring-like coil 49 which extends beyond the light bulb 35 to a terminus 51 sufficiently long to facilitate extension over the battery 33. The coil 49 and coiled portion 43 are sized to be forced fitted over the respective ends of the battery 33 which force fit maintains the orientation of the coil 49 with respect to the terminus 45 to maintain the battery 33 and light bulb 35 in contact in the manner shown in FIG. 2. As seen in FIG. 2, the line 19' includes a loop 53 formed by a retainer 55 and having connected thereto an insulated fiber strip 57 designed, initially, to be interposed between the depression 39 and the elongated member 37 and the coil 49. The end 20' of the line 19' extends through an opening 59 in the coil 49 and is retained there by suitable means.

Figure 5:
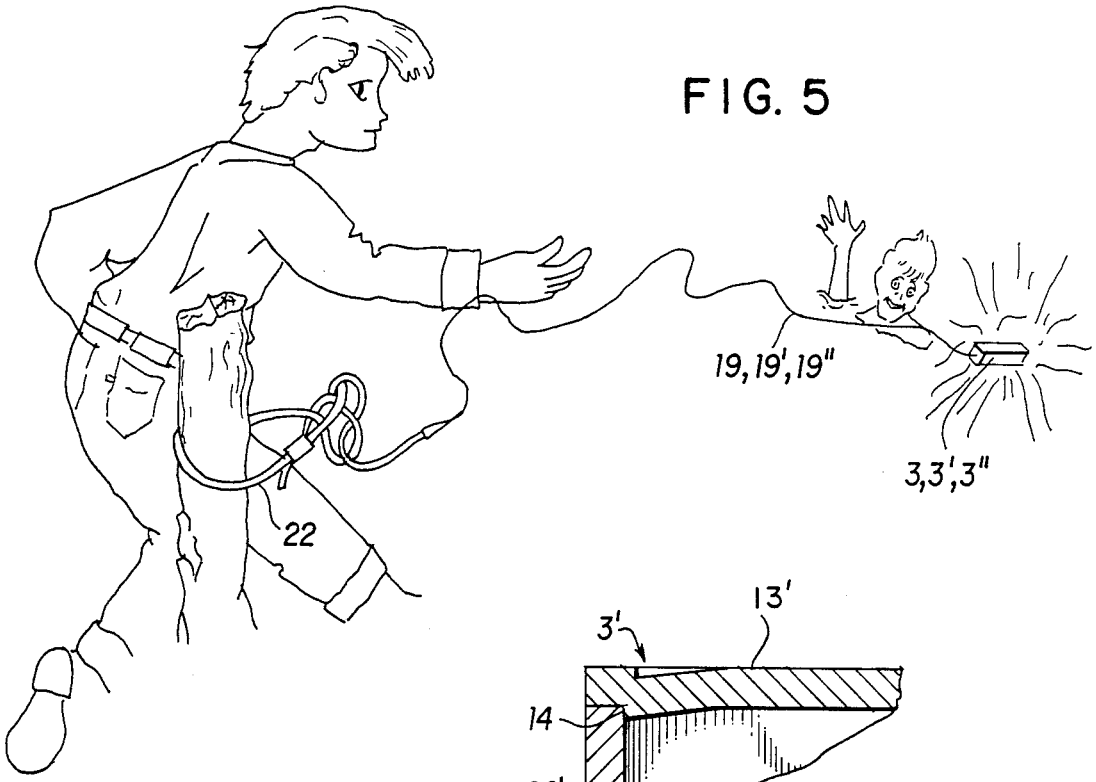
FIG. 5 shows the intended manner of use of the embodiments of the present invention.

In the operation of invention illustrated in FIG. 2, when it is desired to utilize the device 1' in a rescue, with reference to FIGS. 1 and 5, the end 22 of the line 19' is affixed to a rigid fixed object on land in the manner described hereinabove and the line 19' is withdrawn from housing 3' and then is further tugged to pull the strip 57 out from between the coil 49 and contact portion 39 to activate the light bulb 35. Thereafter, the housing 3' may be thrown in the direction where the rescue is to take place. As should be understood with further reference to FIG. 2, when the line 19' has been completely extended to the point where the structure 32 carrying the opening 31 of the member 37 engages the inner surface of the opening 25', further tugging on the line 19' will result in the member 55 being pulled toward the opening 25' whereupon the member 55 is completely removed therefrom allowing the depression 39 to engage the coil 49 and complete the electrical circuit allowing the bulb 35 to illuminate, thereby illuminating the housing 3'. For this purpose, at least the wall 26' of the housing 3' may be made transparent or translucent.

With reference now to FIGS. 3 and 4, an alternative construction of the illumination means and its interaction with the line will be described. With reference to the embodiment of FIGS. 3 and 4, like elements will be described using like double primed reference numerals.

Thus, with reference to FIGS. 3 and 4, it is seen that the housing 3'' has its second chamber 11'' divided into two subchambers **11*a* and 11*b* by a partition member 12. The partition member includes a slot 14 formed therein allowing the blocking member 70 which is attached to the end 20'' of the line 19'' to extend therethrough. As seen in FIG. 3, the blocking member 14 is connected to the end 20'' of the line 19'' by virtue of a loop 71 formed in the line 19'' by virtue of retainer 73**.

With reference to FIG. 4, the chamber **11*b* is seen to have openings 75 and 77 therein which retain spring members 79 and 81 each of which has a coiled portion designed to retain a respective end of the battery 33''. The coiled portion of the spring member 79 is designated by the reference numeral 80 while the coiled portion of the spring member is designated by the reference numeral 82**.

As seen in FIG. 4, at the end of the coiled portion 80, a further S-shaped, curved spring portion 83 is provided having a flat, terminating portion 85 engaging the blocking member 70. The end of the coiled portion 82 of the spring member 81 has a further coiled portion 87 mounted in surrounding relation to the light bulb 35''. As seen in FIG. 4, the light bulb 35'' is mounted in alignment with the flat portion 85 of the spring member 79. As should be understood from FIGS. 3 and 4 when taken in conjunction with FIGS. 1 and 5, when it is desired to utilize the device 1'', the same steps are undertaken as described above with regard to FIGS. 1, 2 and 5 and when the line 19'' has been fully extended, further tugging of the line will pull the blocking member 70 out from between the flat portion 85 of the spring member 79 and the light bulb 35'' thus completing the electrical circuit and allowing the light bulb to illuminate. If desired, the wall 91 may be made transparent or translucent to best facilitate light transmission. Furthermore, the retainer 73 seen in FIG. 3 is made of sufficient diameter to prevent its extending through the hole 25'' (not shown) corresponding to the hole 25 of the housing 3 shown in FIG. 1.

As such, an invention has been disclosed in terms of a preferred embodiment thereof which fulfills each and every one of the objects of the invention as set forth herein above and provides a new and improved lifeline device which is easy to use and quite effective in its use. Of course, various changes, modifications and alterations in the teachings of the present invention may be contemplated by those skilled in the art without departing from the intended spirit and scope of the present invention. As such, it is intended that the present invention only be limited by the terms of the appended claims.

I claim:

1. An improved lifeline device, comprising:

(a) a housing having a first chamber and a second chamber, said first chamber having flotation means therein providing sufficient flotation to allow said housing to float in a body of water;

(b) said second chamber having a wall with an opening therethrough;

(c) a flexible cord in said second chamber having a first end extended through said opening and a second end in said second chamber;

(d) said cord second end being attached to illumination means contained in said second chamber, said illumination means including actuation means to which said cord second end is connected, whereby, when said cord is pulled through said opening, said actuation means is actuated to activate said illumination means.

2. The invention of claim 1, wherein said second chamber includes a cover slidably mounted on said housing.-

3. The invention of claim 1, wherein said cord first end is provided with a loop.

4. The invention of claim 1, wherein said flotation means comprises a pocket of air sealingly retained in said first chamber.

5. The invention of claim 1, wherein said illumination means comprises:

(a) a casing;

(b) a battery and light bulb mounted in said casing in electrical communication; and (c) two contacts comprising said actuation means.

6. The invention of claim 5, wherein said cord second end has a first portion having attached thereto an insulative strip adapted to be interposed between said two contacts, said cord second end has a second portion fixedly secured to said casing and when said cord is pulled through said opening, said strip is pulled from between said contacts to allow said contacts to engage one another to illuminate said bulb.

7. The invention of claim 5, wherein said second chamber includes first and second sub-chambers, said wall with a opening therethrough being in said first sub-chamber, said illumination means being mounted in said second sub-chamber, a partition separating said sub-chambers and having an opening through which said cord extends, said cord second end having an insulative strip attached thereto and adapted to be interposed between said contacts, said strip being pulled from between said contacts when said cord is pulled through said opening to allow said contacts to engage one another to illuminate said bulb.

* * * * *